United States Patent [19]

Jonas

[11] Patent Number: 4,565,293

[45] Date of Patent: Jan. 21, 1986

[54] CONTAINER CLOSURE

[75] Inventor: Thomas S. Jonas, Harefield, United Kingdom

[73] Assignee: National Plastics Limited, Colchester, England

[21] Appl. No.: 630,214

[22] Filed: Jul. 12, 1984

[30] Foreign Application Priority Data

Jul. 19, 1983 [GB] United Kingdom ..... 8319444

[51] Int. Cl.[4] ..... B65D 41/34

[52] U.S. Cl. ..... 215/246; 215/252

[58] Field of Search ..... 215/246, 252

[56] References Cited

U.S. PATENT DOCUMENTS

| | | | |
|---|---|---|---|
| 3,438,528 | 4/1969 | Fields | 215/252 |
| 3,601,273 | 8/1971 | Kutcher . | |
| 3,673,761 | 7/1972 | Leitz | 215/252 X |
| 3,929,246 | 12/1975 | Leitz | 215/252 |
| 4,033,472 | 7/1977 | Aichinger | 215/256 |
| 4,206,851 | 6/1980 | Ostrowsky | 215/246 |
| 4,345,692 | 8/1982 | Obrist et al. | 215/252 |
| 4,432,461 | 2/1984 | Mumford et al. | 215/252 |

FOREIGN PATENT DOCUMENTS

| | | |
|---|---|---|
| 974564 | 11/1971 | United Kingdom . |
| 1312206 | 4/1973 | United Kingdom . |
| 2062593 | 5/1981 | United Kingdom . |
| 2083801 | 3/1982 | United Kingdom . |
| 2111031 | 6/1983 | United Kingdom . |

*Primary Examiner*—Donald F. Norton

*Attorney, Agent, or Firm*—Richard D. Weber

[57] ABSTRACT

A pilfer-proof closure has an inwardly threaded side wall (7) terminating (at 10) at or just below an annular flange means (17) on the neck of the container (14). Shrunk-in below the flange means (17) is a tamper-evident band (9) joined by a small number (usually 3) of bridges (11, 12, 13). One of the bridges (13) is preferably made weaker than the others.

7 Claims, 4 Drawing Figures

CONTAINER CLOSURE

BACKGROUND OF THE INVENTION

This invention relates to a pilfer-proof closure for a container, for example a bottle for a beverage.

To provide such a pilfer-proof closure, the use of a tamper-evident band is common, the band being attached to the lower end of the skirt of the closure by means of a thin wall section or a plurality of bridges.

In many cases, heat has to be applied to the band on the container, sometimes together with the application of a roller, to shrink this band around a bead on the container. Typically, the depth of the band is such that approximately 50% of its depth extends beneath the bead on the container. When the closure is unscrewed from the container, the band will break thus indicating that the container has been opened.

One aim of this invention is to provide an improved design of closure and tamper-evident band to overcome some deficiencies of other designs currently available on the market.

DESCRIPTION OF THE PRIOR ART

The pilfer-proof closure disclosed in U.S. Pat. No. 3,438,528 is adapted to screw onto a screw-threaded neck of a container and to cooperate with an outwardly extending flange means, i.e. a bead encircling the neck of the container below the screw thread. A tamper-evident band attached to the lower rim of the closure body by a plurality of bridges is arranged to engage beneath the flange means on the container neck in such a way that on unscrewing the closure, the bridges, which are frangible and are all of comparable tensile strengh, all fracture so that the band separates completely from the closure body and remains on the container neck. The retention of the tamper-evident band on the container neck imparts an untidy appearance to the container and can have serious disadvantages in the case of returnable containers.

Another pilfer-proof closure, disclosed in U.S. Pat. No. 4,206,851, also comprises a tamper-evident band attached to the lower rim of the closure body by a plurality of bridges, the band having at least one frangible area of reduced strength so that the band, which is engaged beneath the flange means on the container neck, fractures in the frangible area upon unscrewing the closure. The broken band thus remains attached to the closure body by the bridges. In practice, however, the band can fracture at more than one place and it has been found that small pieces of the band can detach themselves and fall into the container.

U.S. Pat. No. 3,673,761 discloses a pilfer-proof closure in which, because of the location of the lower rim of the closure body and the tamper-evident band in relation to the flange means on the container neck, precise application of heat and a mechanical rolling operation is required to deform the tamper-evident band round the flange means.

OBJECTS OF THE INVENTION

One object of a pilfer-proof closure according to the present invention is to provide a tamper-evident band which remains attached to the closure body on first removal and so does not remain untidily on the neck of the container. A further object is to provide a tamper-evident band which remains in one piece, or in comparatively large pieces, attached to the closure by one or more of the bridges, on removal of the closure. A still further object is to facilitate the shrinking in of the tamper-evident band below the flange means.

What constitutes a pilfer-proof closure according to the invention is defined in the following claims.

The reference to a "small number of bridges" in the claims means more than two and, for example, up to five.

The lower edge of the side wall of the closure body must, when the latter is sealingly fitted onto the container, be at least close to the lower extremity of the flange means and preferably is as low as or even lower than the said lower extremity. This arrangement ensures that the bridges remain substantially straight after the tamper-evident band has been shrunk in around the neck and are not bent round the flange means to any significant extent.

Having a small number of bridges (preferably three) means there is a significant spacing between adjacent bridges and this causes the shrunk-in tamper-evident band to adopt a somewhat polygonal shape around the container neck. Such a shape encourages fracture of the band when the pilfer-proof closure is first removed from the container neck.

Suitably the flange means on the container is a continuous flange encircling the container neck.

Where it is required that one bridge be weaker than the others, it can be made thinner than the other bridges.

BRIEF DESCRIPTION OF THE DRAWINGS

The invention will be further described, by way of example, with reference to the accompanying drawings, in which.

DESCRIPTION OF PREFERRED EMBODIMENT

Figure 1:
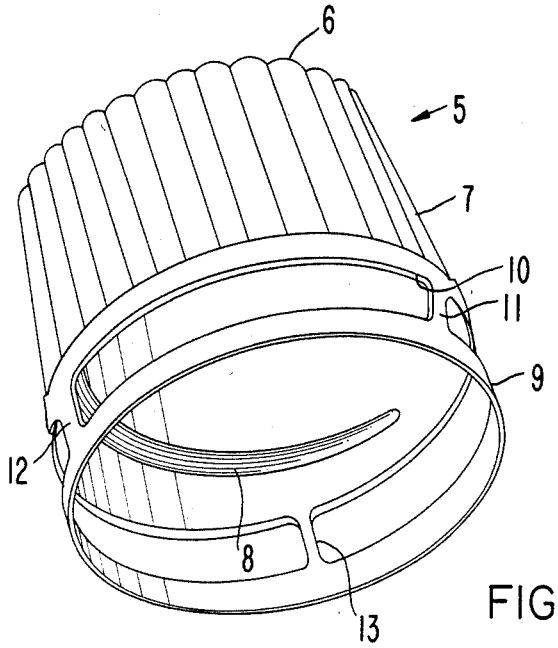
FIG. 1 is a perspective view of one embodiment of closure according to the invention.

The closure shown in the drawings comprises a closure body 5 having an end wall 6 and a depending side wall 7 which is formed on its internal surface with a screw thread 8. An annular tamper-evident band 9 is attached to the lower rim 10 of the closure body 5 by three bridges 11, 12 and 13. The bridge 13 is thinner and weaker than either of the other two bridges 11 and 12.

Figure 2:
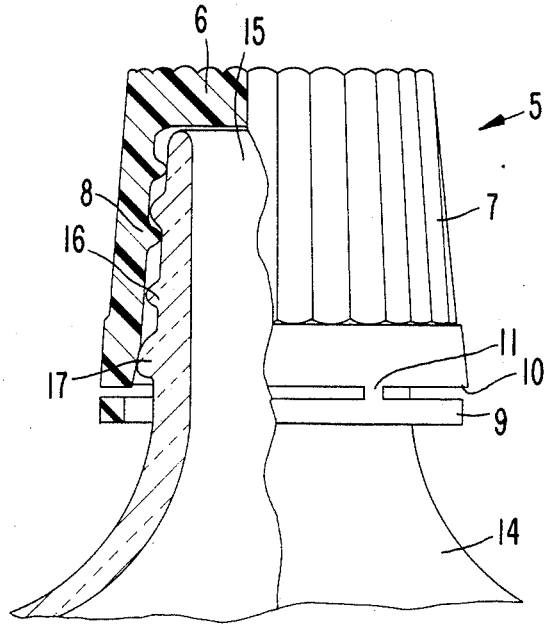
FIG. 2 is a cross-section through the closure of FIG. 1 screwed tightly on a container but prior to heat treatment thereof.

FIG. 2 shows the closure screwed tightly on a container 14 having a neck 15 with an external screw-thread 16. Below the screw-thread 16, an outwardly extending flange 17 integral with the container neck 15 encircles the container neck.

When the closure is screwed tightly on the container 14, the side wall 7 of the closure body 5 extends down on the container so that the lower rim 10 of the closure body 5 is slightly below the level of the lower edge of the flange 17 and the annular band 9 and the three bridges 11, 12, 13 are located entirely below the flange 17.

Figure 3:
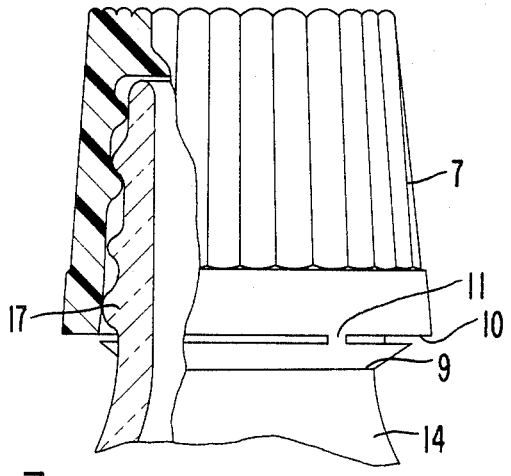
FIG. 3 is a partially cross-sectioned view of the closure and container of FIG. 2 after heat treatment of an annular band of the closure.
Figure 4:
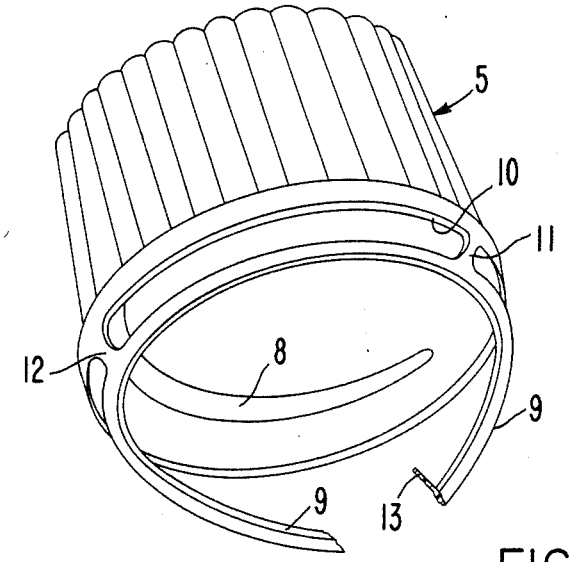
FIG. 4 is a perspective view of the closure of FIG. 3 after removal from the container.

On applying heat to the closure on the container 14 in a heat tunnel, the annular band 9 and the bridges 11, 12 and 13 (which are made of heat-shrinkable material)

shrink to a configuration, somewhat as illustrated in FIG. 3, where the annular band 9 has shrunk under the flange 17. Because the annular band 9 is attached to the closure body by well spaced-apart bridges, upon heat treatment and shrinking it is constrained to adopt an approximately polygonal (in this case triangular) configuration, that is a non-circular configuration in which the sides extending between the straight bridges are slightly outwardly bowed. This configuration, brought about by the provision of a small number of well-spaced bridges as attachment points, helps to ensure that the annular band 9 is more securely lodged, after heat shrinking, beneath the flange 17, than would have been the case if there were more bridges and/or the bridges had been bent round the flange 17 rather than being located wholly below it.

Preferably, the annular band 9 is moulded to a uniform thin section and therefore requires only a comparatively small amount of heat to effect the required degree of shrinkage. Upon heating to a sufficiently high temperature, the annular band 9 shrinks adopting, because of the constraint of the three bridges, the roughly triangular configuration already mentioned.

When the closure is first unscrewed from the container 14, the thinner, weaker bridge 13 breaks as well as the annular band 9. The break in the bridge 13 and the break in the annular band 9 provide clear evidence of opening By making one of the bridges provided to serve as attachment points of the band 9 to the closure body 5 weaker than the others, the possibility of applying forces to the band 9 to break it in more than one place is reduced or eliminated. Thus with one weakened bridge, after removal of the closure from the container 14, there is a high probability that the annular band 9 remains in one piece and is firmly attached to the closure body 5 by the remaining unbroken bridges (in the illustrated case the bridges 11 and 12). Following the first opening, the one-piece tamper-evident band 9 can be easily gripped and torn free of the closure body 5 leaving the closure free of any residual fragments of the annular band 9 when the closure is reapplied to the container.

The closure may be made by injection moulding in a thermoplastics material such as polypropylene.

It is to be understood that the above-described embodiment is merely illustrative of the principles of the invention and that numerous other arrangements may be devised by those skilled in the art without departing from the spirit and scope of the invention.

I claim:

1. A pilfer-proof closure for a container having a screw-threaded neck and an outwardly extending flange means below the screw-thread, said closure comprising:

(a) a closure body having an end wall and a side wall depending from said end wall and internally screw-threaded, (b) an annular tamper-evident band of heat-shrinkable material attached to said side wall, (c) a small number of spaced-apart bridge members attaching said tamper-evident band to said depending side wall, (d) said bridge members being long enough to locate said tamper-evident band below said flange means on the container neck, (e) said band, when heat-shrunk adopting a generally polygonal non-circular shape wherein the sides of the polygon extend between said bridge members and engage under the outwardly extending flange means on the container.

2. A pilfer-proof closure according to claim 1, wherein said annular band has a uniformly thin cross-section throughout its length.

3. A pilfer-proof closure according to claim 1, wherein there are three bridge members only and one of said bridge members is weaker than the other two.

4. In a pilfer-proof closure for a container having a screw-threaded neck and an outwardly extending flange means below the screw-thread, the closure comprising a closure body, an end wall of said closure body, a side wall of said closure body depending from said end wall, said side wall being internally screw-threaded, and an annular tamper-evident band attached to the closure body, the improvement, in which said closure also comprises three substantially equally spaced-apart bridges attaching said annular tamper-evident band to said depending side wall, in which said annular band is of heat-shrinkable material and is arranged to be located below the outwardly extending flange means on the neck of the container, when the closure is screwed tightly onto the container, whereby the annular band will shrink, upon application of heat, under the outwardly extending flange means on the container, one of said bridges being weaker than the other two bridges so that said one bridge is more likely to fracture than the other two on unscrewing the closure from the container.

5. A pilfer-proof closure as claimed in claim 4, wherein said annular band has a uniformly thin cross-section throughout its length.

6. A pilfer-proof closure as claimed in claim 4 after it has been applied to a container having a screw-threaded neck and an outwardly extending flange means below the screw-thread and such that the bridges attaching the heat-shrunk annular band to the closure body are inwardly inclined with respect to the container, the heat-shrunk band being located under the outwardly extending flange means and having a shape which is roughly triangular but with slightly curved sides.

7. A pilfer-proof closure for a container having a screw-threaded neck and an outwardly extending flange means below the screw thread, the closure comprising a closure body, an end wall of the closure body, a side wall depending from the end wall, a lower rim of said side wall, which side wall is internally screw-threaded and extends, when the closure is sealingly fitted to the neck of the container, at least as low as the flange means on the container neck, the closure further comprising an annular tamper-evident band, a small number of bridges spaced around the closure extending downwardly from the rim of said depending side wall and attaching said band to the closure body, said annular band being of heat-shrinkable material and depending from the lower rim of the closure body, whereby the annular band will shrink, upon application of heat when the closure is fitted on its container and engage under the outwardly extending flange means on the container so that the bridges attaching the heat-shrunk annular band to the closure body are inwardly inclined with respect to the container and wherein said heat-shrunk annular band is roughly triangular in shape but with slightly curved sides.

* * * * *